US012319394B2

(12) United States Patent
Okamoto et al.

(10) Patent No.: US 12,319,394 B2
(45) Date of Patent: Jun. 3, 2025

(54) CONTROL DEVICE OF MARINE VESSEL, CONTROL SYSTEM OF MARINE VESSEL, AND MARINE VESSEL

(71) Applicant: YAMAHA HATSUDOKI KABUSHIKI KAISHA, Iwata (JP)

(72) Inventors: Yukitaka Okamoto, Shizuoka (JP); Yasuhiko Hemmi, Shizuoka (JP); Takuya Murayama, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 559 days.

(21) Appl. No.: 17/831,470

(22) Filed: Jun. 3, 2022

(65) Prior Publication Data

US 2022/0402583 A1 Dec. 22, 2022

(30) Foreign Application Priority Data

Jun. 21, 2021 (JP) ..... 2021-102319

(51) Int. Cl.
*B63H 21/21* (2006.01)
*B63B 34/10* (2020.01)
*B63C 9/00* (2006.01)

(52) U.S. Cl.
CPC ..... *B63C 9/0005* (2013.01); *B63B 34/10* (2020.02); *B63H 21/21* (2013.01); *B63H 2021/216* (2013.01)

(58) Field of Classification Search
CPC ..... B63C 9/2005; B63H 21/21; B63H 2021/216; B63B 34/10
See application file for complete search history.

(56) References Cited

U.S. PATENT DOCUMENTS 4,744,322 A * 5/1988 Nakase ..... B63H 21/213 440/6
5,171,171 A * 12/1992 Tani ..... B63B 34/10 440/85

(Continued)

FOREIGN PATENT DOCUMENTS

JP 2001-088789 A 4/2001
JP 2003-104286 A 4/2003

(Continued)

*Primary Examiner* — S. Joseph Morano
*Assistant Examiner* — Jovon E Hayes
(74) *Attorney, Agent, or Firm* — Keating & Bennett, LLP

(57) ABSTRACT

A control device of a marine vessel includes a wireless master unit to wirelessly communicate with a wireless slave unit possessed or worn by a vessel operator, and a processor configured or programmed to function as a detecting unit to detect that an engaging portion of a lanyard connectable to a connecting portion provided on a hull of the marine vessel is detached from the connecting portion, an obtaining unit to obtain a physical quantity that indicates at least one of a rotation speed of a drive source that propels the hull and a vessel speed, a judging unit to judge a state of wireless communication between the wireless master unit and the wireless slave unit, and a control unit to control the drive source based on a detection result obtained by the detecting unit, the physical quantity obtained by the obtaining unit, and a judgment result obtained by the judging unit.

16 Claims, 6 Drawing Sheets

(56) References Cited

U.S. PATENT DOCUMENTS

| | | | | |
|---|---|---|---|---|
| 5,394,820 | A * | 3/1995 | Dach | B63B 35/665 114/55.58 |
| 5,592,169 | A * | 1/1997 | Nakamura | G07C 9/00944 341/173 |
| 6,024,068 | A * | 2/2000 | Nakase | F02B 61/045 123/198 DB |
| 6,352,045 | B1 * | 3/2002 | Takashima | B60R 25/04 180/272 |
| 6,404,071 | B1 * | 6/2002 | Kurano | B63J 99/00 290/40 R |
| 7,026,912 | B2 * | 4/2006 | Suzuki | B63J 99/00 340/10.52 |
| 7,131,876 | B2 * | 11/2006 | Hattori | B63J 99/00 440/1 |
| 7,198,527 | B2 * | 4/2007 | Shirayanagi | B63H 21/213 340/5.62 |
| 7,227,283 | B2 * | 6/2007 | Suzuki | B63H 21/213 307/326 |
| 10,121,609 | B2 * | 11/2018 | Coursol | H01H 3/12 |
| 11,097,826 | B1 * | 8/2021 | Dannenberg | F02N 11/101 |
| 11,250,653 | B2 * | 2/2022 | Gonring | B60R 25/04 |
| 2018/0099734 | A1 * | 4/2018 | Schibli | B63H 21/21 |
| 2020/0043315 | A1 * | 2/2020 | Watanabe | B63C 9/0005 |
| 2022/0402583 | A1 * | 12/2022 | Okamoto | B63C 9/0005 |

FOREIGN PATENT DOCUMENTS

| | | | |
|---|---|---|---|
| JP | 4205261 | B2 | 1/2009 |
| JP | 2014-218165 | A | 11/2014 |
| JP | 2020-019424 | A | 2/2020 |

* cited by examiner

*FIG. 5*

| | AT HIGH SPEED | | | | AT LOW SPEED | | | |
|---|---|---|---|---|---|---|---|---|
| LANYARD | CONNECTED | CONNECTED | UNCONNECTED | UNCONNECTED | CONNECTED | CONNECTED | UNCONNECTED | UNCONNECTED |
| WIRELESS COMMUNICATION | COMMUNICATION ON | COMMUNICATION OFF | COMMUNICATION ON | COMMUNICATION OFF | COMMUNICATION ON | COMMUNICATION OFF | COMMUNICATION ON | COMMUNICATION OFF |
| BREAKAWAY JUDGEMENT | | | BREAKAWAY | BREAKAWAY | | BREAKAWAY | | BREAKAWAY |
| PROCESSING | NORMAL OPERATION | DECELERATION OPERATION | ENGINE STOP | ENGINE STOP | NORMAL OPERATION | FIXED POINT HOLDING | LIMITED OPERATION | ENGINE STOP |

CONTROL DEVICE OF MARINE VESSEL, CONTROL SYSTEM OF MARINE VESSEL, AND MARINE VESSEL

CROSS REFERENCE TO RELATED APPLICATIONS

This application claims the benefit of priority to Japanese Patent Application No. 2021-102319, filed on Jun. 21, 2021. The entire contents of this application are hereby incorporated herein by reference.

BACKGROUND OF THE INVENTION

1. Field of the Invention

The present invention relates to a control device of a marine vessel, a control system of a marine vessel, and a marine vessel.

2. Description of the Related Art

It is known that in a marine vessel such as a PWC (Personal Watercraft), a lanyard switch is used to judge breakaway of a vessel operator from a hull (see, for example, Japanese Laid-Open Patent Publication (kokai) No. 2020-19424 and Japanese Laid-Open Patent Publication (kokai) No. 2003-104286). This type of marine vessel navigates in a state that an engaging part of a lanyard is connected to the lanyard switch, and when the engaging part is detached, this type of marine vessel takes emergency measures such as stopping an engine. As a result, it is possible to prevent the vessel operator who broke away from the hull from being left behind. Japanese Laid-Open Patent Publication (kokai) No. 2003-104286 discloses that even if the engaging part of the lanyard is detached, stopping the engine is delayed depending on a condition such as a vessel speed.

Further, in Japanese Laid-Open Patent Publication (kokai) No. 2020-19424, in order to estimate a positional relationship between the hull and the vessel operator, the lanyard and wireless communication are used simultaneously. When the engaging part of the lanyard is detached, the marine vessel communicates with a wireless mobile device possessed by the vessel operator, and judges whether or not it is necessary to transmit a rescue signal according to the communication status.

In order to enable an emergency response function corresponding to the breakaway of the vessel operator from the hull, the vessel operator has to always wear the lanyard. However, in recent years, there has been an increasing demand to improve the comfort of the vessel operator on the hull.

SUMMARY OF THE INVENTION

Preferred embodiments of the present invention provide control devices of marine vessels, control systems of marine vessels, and marine vessels that are each able to improve the user comfort with respect to the use of a lanyard.

According to a preferred embodiment of the present invention, a control device of a marine vessel includes a wireless master unit to wirelessly communicate with a wireless slave unit that is able to be possessed or worn by a vessel operator, and a processor configured or programmed to function as a detecting unit to detect that an engaging portion of a lanyard connectable to a connecting portion provided on a hull of a marine vessel is detached from the connecting portion, an obtaining unit to obtain a physical quantity that indicates at least one of a rotation speed of a drive source that propels the hull and a vessel speed, a judging unit to judge a state of wireless communication between the wireless master unit and the wireless slave unit, and a control unit to control the drive source based on a detection result obtained by the detecting unit, the physical quantity obtained by the obtaining unit, and a judgment result obtained by the judging unit.

According to another preferred embodiment of the present invention, a control system of a marine vessel includes the control device described above, the lanyard, and the wireless slave unit to wirelessly communicate with the wireless master unit of the control device.

According to another preferred embodiment of the present invention, a marine vessel includes the control device of the marine vessel.

According to another preferred embodiment of the present invention, a control system of a marine vessel includes a lanyard including an engaging portion connectable to a connecting portion provided on a hull of a marine vessel and integral with a wireless slave unit, a wireless master unit to wirelessly communicate with the wireless slave unit, and a processor configured or programmed to function as a detecting unit to detect that the engaging portion of the lanyard is detached from the connecting portion, a judging unit to judge a state of wireless communication between the wireless master unit and the wireless slave unit, and a control unit to determine whether or not a vessel operator broke away from the hull based on at least one of a detection result obtained by the detecting unit and a judgment result obtained by the judging unit.

According to a preferred embodiment of the present invention, the detecting unit detects that the engaging portion of the lanyard connectable to the connecting portion provided on the hull of the marine vessel is detached from the connecting portion. The obtaining unit obtains the physical quantity that indicates at least one of the rotation speed of the drive source that propels the hull and the vessel speed. The wireless master unit wirelessly communicates with the wireless slave unit that is able to be possessed or worn by the vessel operator. The judging unit judges the state of the wireless communication between the wireless master unit and the wireless slave unit. The control unit controls the drive source based on the detection result obtained by the detecting unit, the physical quantity obtained by the obtaining unit, and the judgment result obtained by the judging unit. As a result, it is possible to improve the user comfort with respect to the use of the lanyard.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 5 is a diagram that shows a combination of judgments and processes during marine vessel maneuvering control.

DETAILED DESCRIPTION OF THE PREFERRED EMBODIMENTS

Hereinafter, preferred embodiments of the present invention will be described with reference to the drawings.

Figure 1:
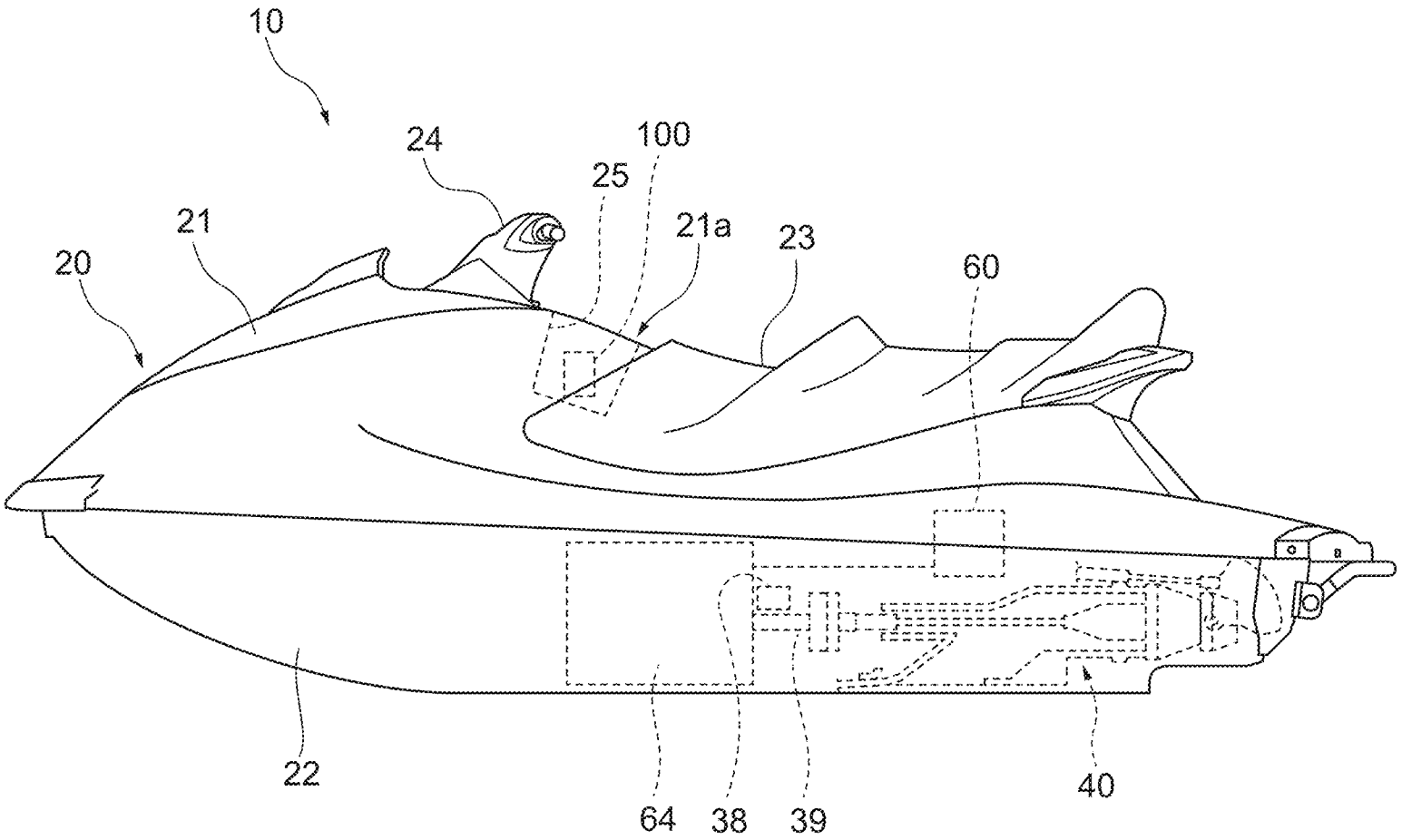
FIG. 1 is a schematic side view of a marine vessel to which a control device according to a preferred embodiment of the present invention is applied.

FIG. 1 is a schematic side view of a marine vessel to which a control device according to a preferred embodiment of the present invention is applied. As an example, this marine vessel is a jet propulsion boat 10. The jet propulsion boat 10 is a so-called personal watercraft (PWC). The jet propulsion boat 10 includes a hull 20, an engine 64, a jet propulsion mechanism 40, and a controller 60.

The hull 20 includes a deck 21 and a hull 22. A saddle type seat 23 is attached to the deck 21. A steering handle 24 to steer the hull 20 is provided on the deck 21. A waterproof case 25 is attached to an opening 21*a* in the deck 21. A mobile terminal device 100 is housed within the waterproof case 25. The mobile terminal device 100 may be the property of a vessel operator or may be always provided in the jet propulsion boat 10. The mobile terminal device 100 is wirelessly connected to the controller 60. Examples of the mobile terminal device 100 include a multifunctional mobile terminal device (i.e., a so-called smartphone). It should be noted that providing the mobile terminal device 100 is optional.

The engine 64 is located in the inside of the hull 20. The engine 64 includes a crank shaft 39. A rotation speed sensor 38 detects a rotation speed NE of the engine 64. The crank shaft 39 extends rearward from the engine 64 and is connected to the jet propulsion mechanism 40. The jet propulsion mechanism 40 is driven by the engine 64. The jet propulsion mechanism 40 propels the hull 20 by sucking in water around the hull 20 and jetting out the water.

Figure 2:
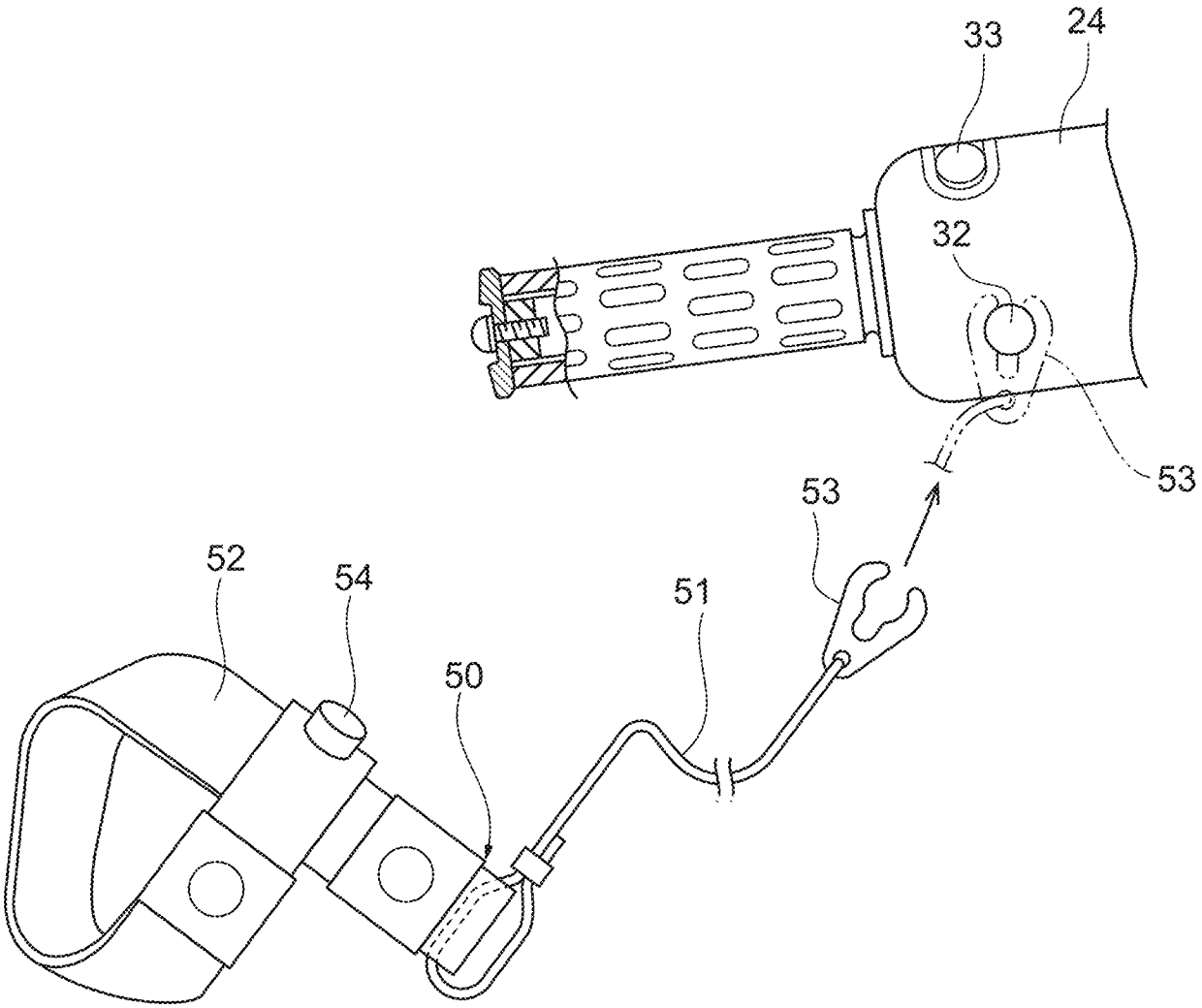
FIG. 2 is a diagram that shows a steering handle and a lanyard.

FIG. 2 is a diagram that shows the steering handle 24 and a lanyard 50. As shown in FIG. 2, the steering handle 24 is provided with a lanyard switch 32 and an engine start switch 33. The engine start switch 33 is an operation piece to start the engine 64 by a manual operation. In addition, by operating an engine stop switch (not shown), the vessel operator is able to stop the engine 64 by a manual operation.

The lanyard 50 includes a cord 51, an attachment portion 52 attached to the wrist of the vessel operator or the like, and an engaging portion 53. The engaging portion 53 is a plate-shaped member that is connectable to a connecting portion 32*c* (see FIGS. 3A and 3B) of the lanyard switch 32, i.e., that is able to be inserted/extracted with respect to the connecting portion 32*c* of the lanyard switch 32. In addition, a wireless slave unit 54 is attached to any portion of the lanyard 50, for example, the attachment portion 52 of the lanyard 50.

Figure 3A:
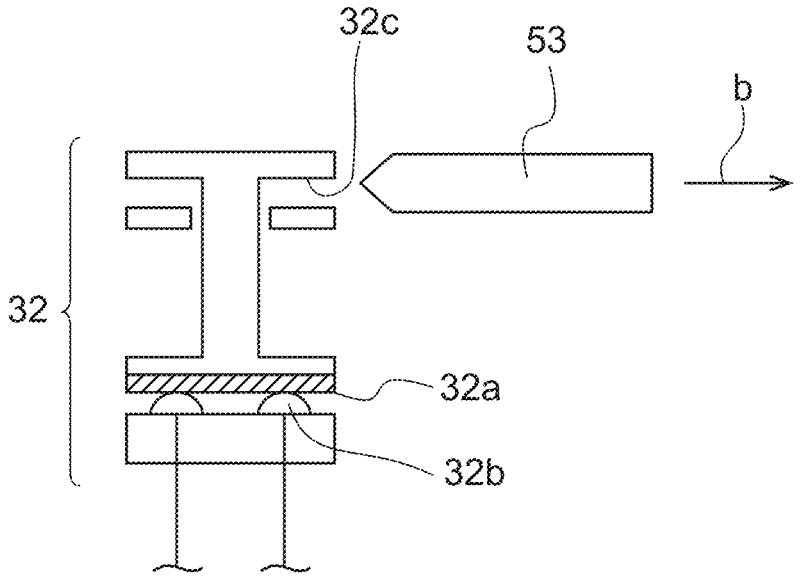
FIGS. 3A and 3B are schematic views that show inserting/extracting states of an engaging portion of the lanyard with respect to a lanyard switch.
Figure 3B:
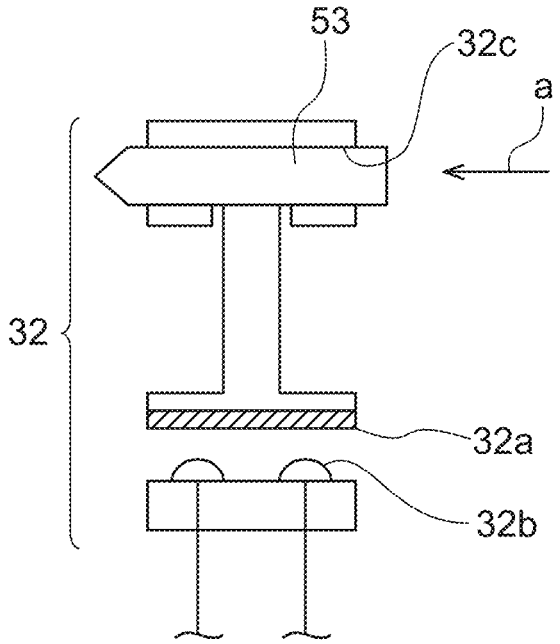

FIGS. 3A and 3B are schematic views that show inserting/extracting states of the engaging portion 53 of the lanyard 50 with respect to the lanyard switch 32. Specifically, FIG. 3A shows a state in which the engaging portion 53 is detached from (is extracted from) the lanyard switch 32, and FIG. 3B shows a state in which the engaging portion 53 is inserted into (is connected to) the lanyard switch 32.

As shown in FIGS. 3A and 3B, the lanyard switch 32 includes an upper side contact 32*a*, a lower side contact 32*b*, and the connecting portion 32*c*. The connecting portion 32*c* and the upper side contact 32*a* are always urged toward the lower side contact 32*b* by a spring or the like (not shown). As shown in FIG. 3A, in the state in which the engaging portion 53 is detached from the connecting portion 32*c* of the lanyard switch 32, the upper side contact 32*a* comes into contact with the lower side contact 32*b*, and the lanyard switch 32 comes into a conduction state. Focusing on a connection relationship between the connecting portion 32*c* and the engaging portion 53, this state is referred to as "a lanyard unconnected state". On the other hand, as shown in FIG. 3B, when the engaging portion 53 is engaged with the connecting portion 32*c* of the lanyard switch 32, the upper side contact 32*a* rises and separates from the lower side contact 32*b*, and the lanyard switch 32 is no longer in the conduction state. Similarly, focusing on the connection relationship between the connecting portion 32*c* and the engaging portion 53, this state is referred to as "a lanyard connected state".

The vessel operator usually attaches the attachment portion 52 of the lanyard 50 to his/her arm or the like and navigates the marine vessel. However, sometimes it is inconvenient to keep the attachment portion 52 of the lanyard 50 on the vessel operator's arm or the like while the marine vessel navigates at low speed. On the other hand, if the engine 64 is stopped just due to temporarily removing the attachment portion 52 of the lanyard 50 from the vessel operator's arm or the like, comfort in navigation is also reduced. Therefore, as will be described below, the controller 60 performs marine vessel maneuvering control that includes control of the engine 64 based on a physical quantity obtained, an engagement state of the engaging portion 53 with respect to the lanyard switch 32 (the lanyard connected state/the lanyard unconnected state), and a state of wireless communication with the wireless slave unit 54. The physical quantity referred to here indicates the value of a vessel speed. The physical quantity referred to here may indicate the value of the rotation speed NE of the engine 64 that functions as a drive source.

Figure 4:
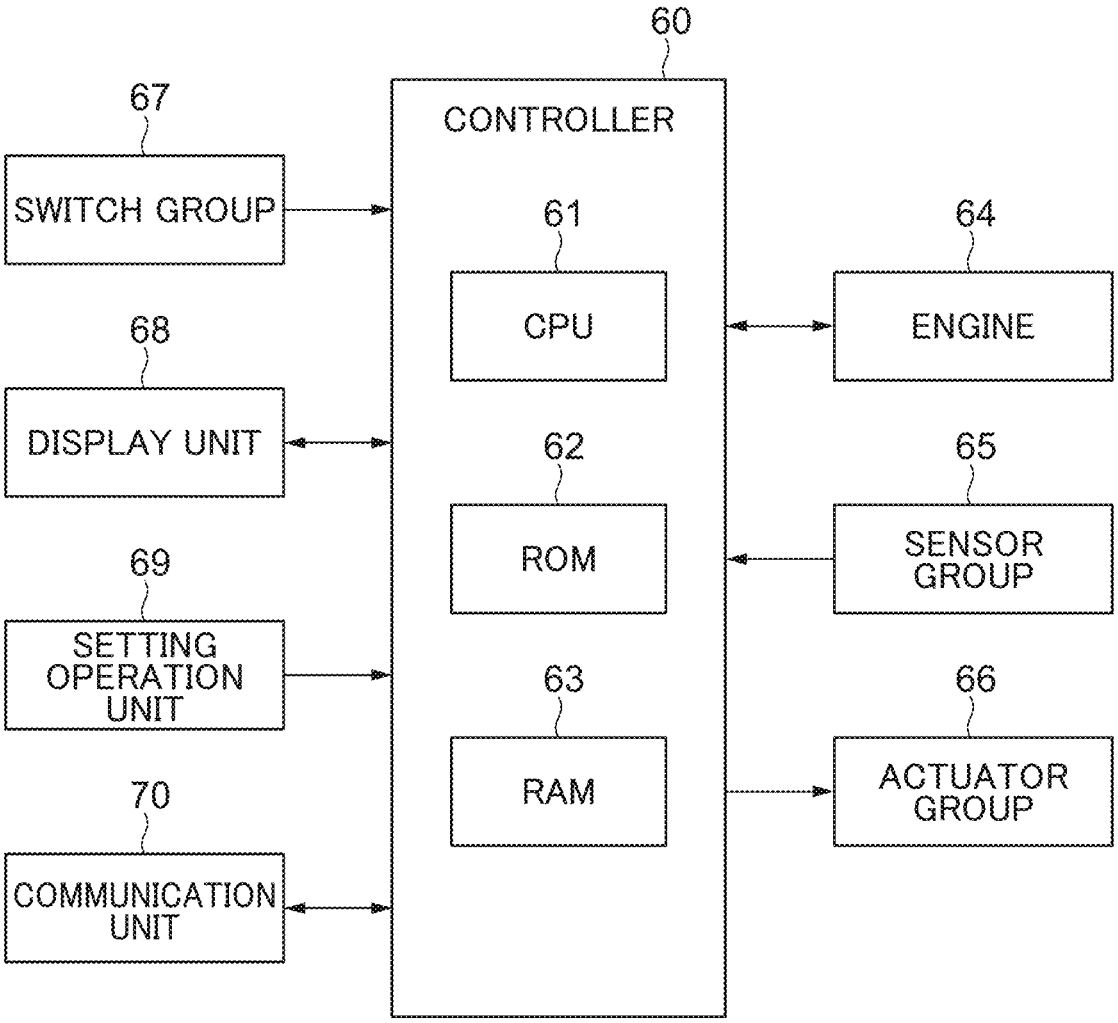
FIG. 4 is a block diagram of a jet propulsion boat.

FIG. 4 is a block diagram of the jet propulsion boat 10. The jet propulsion mechanism 40 includes the controller 60, the engine 64, a switch group 67, a display unit 68, a setting operation unit 69, a communication unit 70, a sensor group 65, and an actuator group 66. The control device that controls the engine 64 includes the controller 60 and the communication unit 70. A control system includes the control device, the wireless slave unit 54, and the lanyard 50.

The controller 60 includes a CPU (Central Processing Unit) 61, a ROM (Read Only Memory) 62, a RAM (Random Access Memory) 63, and a timer (not shown). The ROM 62 stores a control program. The CPU 61 realizes various kinds of control processes by expanding (running) the control program stored in the ROM 62, on the RAM 63 and executing it. The RAM 63 provides a working area for the CPU 61 to execute the control program.

The switch group 67 includes the lanyard switch 32 and the engine start switch 33 (see FIG. 2). The display unit 68 displays various kinds of information. The setting operation unit 69 includes an operation piece to perform operations related to marine vessel maneuvering, a setting operation piece to perform various kinds of settings, and an input operation piece to input various kinds of instructions (none of which are shown).

The communication unit 70 functions as a wireless master unit that wirelessly communicates with the wireless slave unit 54. The communication unit 70 includes a wireless interface (not shown). As this wireless interface, for example, Bluetooth (registered trademark), BAN (body area network), NFC (near field communication), Wi-Fi (wireless fidelity), and the like may be used.

In addition to the rotation speed sensor 38 described above, the sensor group 65 includes a hull speed sensor, a hull acceleration sensor, a steering angle sensor, and the like (none of which are shown). A GPS (Global Positioning System) or the like may be used as the hull speed sensor. The hull speed sensor detects a vessel speed V which is a speed of navigation of the hull 20. The rotation speed sensor 38 detects the number of revolutions per unit time of the engine 64 (i.e., the rotation speed NE of the engine 64). In addition, in the sensor group 65, the hull acceleration sensor detects an acceleration of navigation of the hull 20. The steering angle sensor detects a rotation angle when the steering handle 24 is rotated. Each detection result obtained by the sensor group 65 is supplied to the controller 60.

The actuator group 66 includes an actuator that drives a deflector located within the jet propulsion mechanism 40. This deflector is a component to change the direction of a jet flow to the left or right. The actuator group 66 also includes an actuator to realize automatic operation such as a mechanism that automatically operates the shift state and the steering handle 24.

FIG. 5 is a diagram that shows a combination of judgments and processes during the marine vessel maneuvering control. In a table shown in FIG. 5, "at high speed" and "at low speed" are classified according to a threshold value TH of the vessel speed V. In the present preferred embodiment, in the case that the vessel speed V exceeds the threshold value TH, the CPU 61 determines "at high speed", and on the other hand, in the case that the vessel speed V does not exceed the threshold value TH, the CPU 61 determines "at low speed". It is assumed that the threshold value TH is, for example, 8 Km/h. In addition, instead of the vessel speed V, "at high speed" and "at low speed" may be classified according to the rotation speed NE of the engine 64. In this case, the threshold value TH is set to, for example, 2000 rpm.

The threshold value TH may be set to a value equal to or lower than an idling speed of the engine 64. The idling speed is, for example, 1300 rpm. It should be noted that the values of the threshold value TH and the idling speed are not limited to the exemplified values. Further, "at high speed" and "at low speed" may be defined by using a physical quantity other than the vessel speed V and the rotation speed NE, and a threshold value corresponding to the physical quantity.

"Connected" and "unconnected" in the row of "lanyard" in the table shown in FIG. 5 indicate the lanyard connected state in which the engaging portion 53 of the lanyard 50 is engaged with the connecting portion 32*c* of the lanyard switch 32, and the lanyard unconnected state in which the engaging portion 53 of the lanyard 50 is not engaged with the connecting portion 32*c* of the lanyard switch 32, respectively. The CPU 61 determines "connected" or "unconnected" of the lanyard 50 based on electrical contact (the conduction state) between the upper side contact 32*a* and the lower side contact 32*b*.

"Communication ON" and "communication OFF" in the row of "wireless communication" in the table shown in FIG. 5 indicate that the wireless communication between the communication unit 70 and the wireless slave unit 54 is established, and that the wireless communication between the communication unit 70 and the wireless slave unit 54 is not established, respectively. The CPU 61 determines "communication ON" or "communication OFF" based on the strength of a radio wave signal from the wireless slave unit 54, the success or failure of the communication with the wireless slave unit 54, or the like.

"Breakaway" in the row of "breakaway judgment" in the table shown in FIG. 5 indicates that the vessel operator broke away from the hull 20. "Breakaway" also includes a case that the vessel operator falls into the water. Not only "at high speed" but also "at low speed", the CPU 61 determines whether or not it is "breakaway" based on the judgment result of "connected" or "unconnected" of the lanyard 50 and the judgment result of "communication ON" or "communication OFF" in the wireless communication.

"Processing" in the table shown in FIG. 5 refers to the contents of the marine vessel maneuvering control performed by the controller 60. "Normal operation" in the table shown in FIG. 5 is normal navigation such as steering, propulsion, etc. performed by the vessel operator, and is automatic navigation when an automatic navigation mode is enabled. "Deceleration operation" in the table shown in FIG. 5 is a process of controlling the engine 64 so that the vessel speed V or the rotation speed NE gradually decreases. "Engine stop" in the table shown in FIG. 5 is a process of forcibly stopping the engine 64.

"Fixed point holding" in the table shown in FIG. 5 is a control that keeps the hull 20 within a certain range. The control of "fixed point holding" (hereinafter, also referred to as "dynamic positioning control") is realized by drive control of the engine 64 and the actuator group 66. For example, based on each detection result obtained by the sensor group 65, the controller 60 automatically operates the shift and the steering handle 24, and at the same time, controls a water flow direction and a water flow strength in the jet propulsion mechanism 40. Moreover, in "fixed point holding" (in the dynamic positioning control), the controller 60 may set the shift state to a neutral position. At this time, the controller 60 may control the engine 64 so as to become the idling speed.

"Limited operation" in the table shown in FIG. 5 is an operation of controlling the engine 64 so that the vessel speed V does not become too fast. For example, the controller 60 controls the vessel speed V or the rotation speed NE with a predetermined value as an upper limit. The predetermined value referred to here is a value equal to or less than the above-mentioned threshold value TH, and is stored in the ROM 62 in advance. Moreover, the execution of "engine stop" or "fixed point holding" corresponds to the activation of the "emergency response function".

Figure 6:
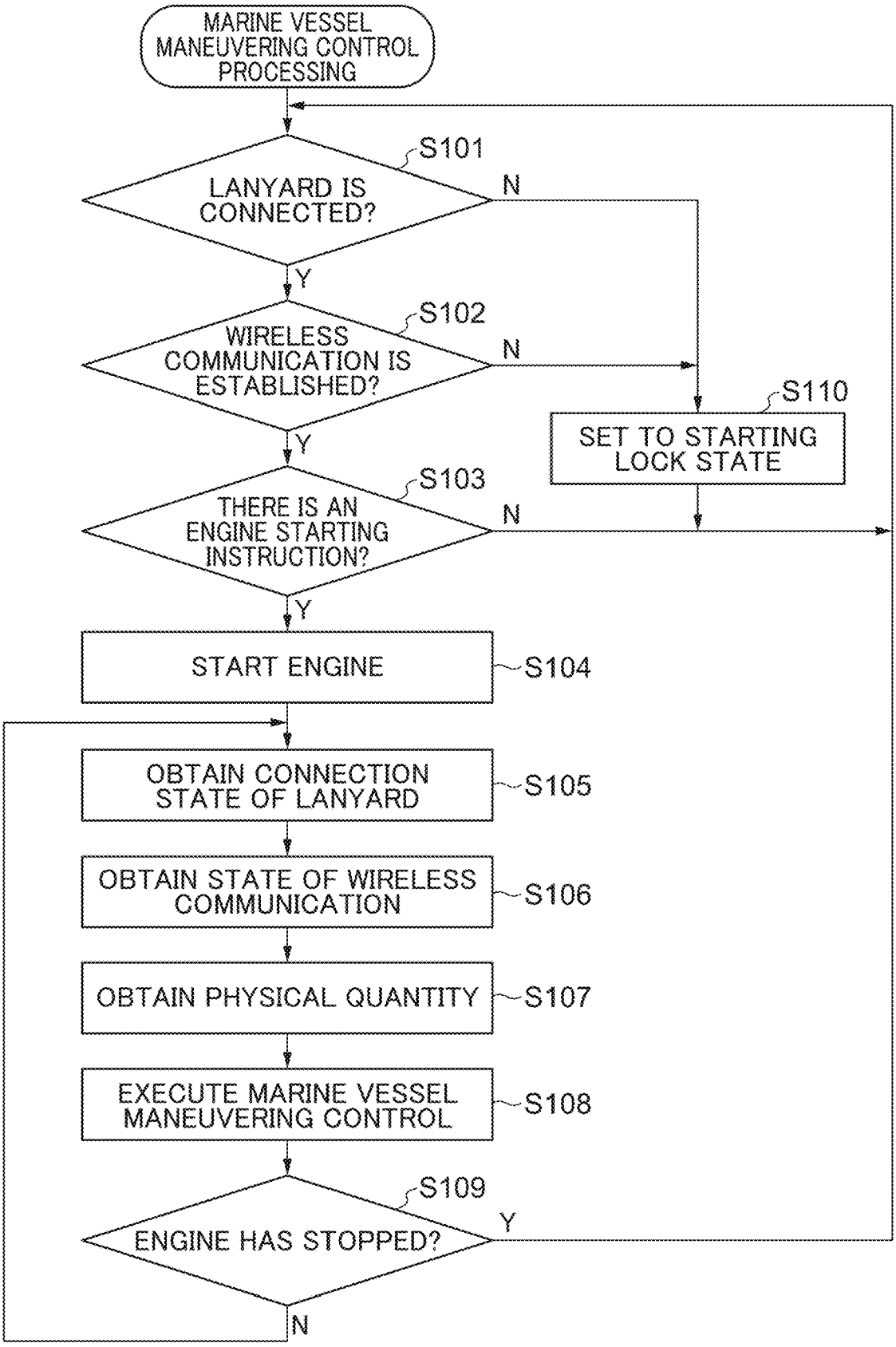
FIG. 6 is a flowchart that shows a marine vessel maneuvering control process.

FIG. 6 is a flowchart that shows a marine vessel maneuvering control process. The marine vessel maneuvering control process is realized by the CPU 61 expanding the program stored in the ROM 62, on the RAM 63 and executing it. The marine vessel maneuvering control process starts when a main power is turned on, and ends when the main power is turned off. In the marine vessel maneuvering control process, the CPU 61 functions as a detecting unit which detects that the engaging portion 53 of the lanyard 50 is detached from the connecting portion 32*c* of the lanyard switch 32. In the marine vessel maneuvering control process, the CPU 61 also functions as an obtaining unit to obtain the vessel speed V, a judging unit to judge the state of the wireless communication between the wireless slave unit 54 and the communication unit 70, and a control unit to control the engine 64.

As shown in FIG. 6, in step S101, the CPU 61 determines whether or not the lanyard 50 is in the connected state (the lanyard connected state) based on the conduction state between the upper side contact 32*a* and the lower side contact 32*b* in the lanyard switch 32. Then, in the case that the upper side contact 32*a* and the lower side contact 32*b* are in the conduction state, since the CPU 61 is able to determine that the lanyard 50 is not in the connected state (the engaging portion 53 of the lanyard 50 is detached from the connecting portion 32*c* of the lanyard switch 32), thus in step S110, the CPU 61 sets a starting lock state. In the starting lock state, the CPU 61 prohibits starting of the engine 64. Therefore, even if the engine start switch 33 (see FIG. 2) is pressed down, the engine 64 does not start. As a result, since the connection of the lanyard 50 is a prerequisite to start the engine 64, a security lock function is realized. After step S110, the CPU 61 returns to step S101.

As the result of the judgment in step S101, in the case that the upper side contact 32*a* and the lower side contact 32*b* are not in the conduction state, the CPU 61 determines that the lanyard 50 is in the connected state (the engaging portion 53 of the lanyard 50 is inserted into the connecting portion 32*c* of the lanyard switch 32), and proceeds to step S102. In step S102, based on the strength of the radio wave signal from the wireless slave unit 54, or the like, the CPU 61 determines whether or not the wireless communication between the communication unit 70 and the wireless slave unit 54 is established ("communication ON"). Then, in the case that the wireless communication between the communication unit 70 and the wireless slave unit 54 is not established, the CPU 61 proceeds to step S110. As a result, it is a condition to start the engine 64 that the wireless slave unit 54 is able to wirelessly communicate with the communication unit 70 and is within a communicable range. Therefore, since it is prevented that the engine 64 is started by another person in a state where the vessel operator wearing the lanyard 50 is away from the hull 20, the security lock function is realized.

On the other hand, in the case that the wireless communication between the communication unit 70 and the wireless slave unit 54 is established, the CPU 61 proceeds to step S103. Therefore, in order for the start of the engine 64 to be permitted, it is necessary that not only the lanyard 50 is connected to the lanyard switch 32 but also the wireless slave unit 54 is wirelessly communicating with the communication unit 70. As a result, the security lock function is enhanced. Although the starting lock state is released by inputting a predetermined code, in order to start the engine 64, it is necessary to judge YES in step S102.

In step S103, the CPU 61 determines whether or not there is an engine starting instruction issued by pressing down the engine start switch 33 (see FIG. 2). Then, in the case that there is no engine starting instruction issued, the CPU 61 returns to step S101. On the other hand, in the case that the engine starting instruction is issued, the CPU 61 starts the engine 64 in step S104.

In step S105, the CPU 61 obtains a connection state of the lanyard 50 (the lanyard connected state or the lanyard unconnected state). In step S106, the CPU 61 obtains the state of the wireless communication between the communication unit 70 and the wireless slave unit 54 ("communication ON" or "communication OFF"). In step S107, the CPU 61 obtains the vessel speed V or the rotation speed NE as the physical quantity. Here, it is assumed that the vessel speed V is obtained. Further, the physical quantity obtained in step S107 is stored in the RAM 63.

In step S108, the CPU 61 executes the marine vessel maneuvering control. That is, based on the connection state of the lanyard 50, the state of the wireless communication, and the vessel speed V, the CPU 61 executes the corresponding marine vessel maneuvering control among the processes shown in FIG. 5 ("normal operation", "deceleration operation", "fixed point holding", "limited operation", and "engine stop"). At this time, "breakaway judgment" is also executed.

With reference to FIG. 5, several examples of the marine vessel maneuvering control executed in step S108 will be described.

In the case that the marine vessel (the hull 20) navigates "at high speed" and the lanyard 50 is in the lanyard unconnected state, it is judged that the situation is "breakaway" regardless of the judgment result of "communication ON" or "communication OFF", and the engine 64 is stopped. Since the lanyard connected state/the lanyard unconnected state depends on presence or absence of a wired connection, it is possible to make a quicker judgment than the judgment of presence or absence of establishment of the wireless communication. Therefore, by judging that the situation is "breakaway" regardless of the judgment result of "communication ON" or "communication OFF", it is possible to quickly stop the engine 64 when the marine vessel navigates "at high speed" and the engaging portion 53 of the lanyard 50 is detached from the lanyard switch 32.

In the case that the marine vessel navigates "at high speed" and the lanyard 50 is in the lanyard connected state and the state of the wireless communication becomes "communication OFF", "deceleration operation" described above is executed. In such a situation, there is also a possibility that a battery of the wireless slave unit 54 has been exhausted. Therefore, by performing "deceleration operation", it is possible to reduce a speed at which the hull 20 moves away from a place where the hull 20 was located at a time when it is judged that the situation is as described above, and it is also possible to inform the vessel operator that there is a possibility that the battery of the wireless slave unit 54 is dead. It should be noted that the notification may be by a sound or a display that there is the possibility that the battery of the wireless slave unit 54 is dead when performing "deceleration operation".

In the case that the marine vessel navigates "at low speed" and the state of the wireless communication becomes "communication OFF", it is judged that the situation is "breakaway" regardless of the judgment result of the lanyard connected state or the lanyard unconnected state. Therefore, during the marine vessel navigating "at low speed", it is possible to judge presence or absence of "breakaway" based on the state of the wireless communication. In particular, in the case that the marine vessel navigates "at low speed" and the lanyard 50 is in the lanyard connected state and the state of the wireless communication becomes "communication OFF", since there is a possibility that the vessel operator falls into the water, "fixed point holding" described above is executed. On the other hand, in the case that the marine vessel navigates "at low speed" and the lanyard 50 is in the lanyard unconnected state and the state of the wireless communication becomes "communication OFF", since there is a higher possibility that the vessel operator falls into the water than that in the case that the lanyard 50 is in the lanyard connected state, the engine 64 is stopped. It should be noted that the controller 60 may control the vessel speed V or the rotation speed NE with the predetermined value described above as the upper limit instead of "fixed point holding" described above.

In the case that the marine vessel navigates "at low speed" and the lanyard 50 is in the lanyard unconnected state and the state of the wireless communication becomes "communication ON", "limited operation" described above is executed. As a result, even in the case that the lanyard 50 is detached from the vessel operator's body, when the state of the wireless communication is "communication ON", "engine stop" or the like is not executed and it is possible to reduce the movement of the hull 20 to a certain range. Moreover, since the emergency response function is activated when the state of the wireless communication becomes "communication OFF", the emergency response function is maintained even in the case that the lanyard 50 is detached from the vessel operator's body.

After step S108, the CPU 61 determines in step S109 whether or not the engine 64 has stopped. Then, in the case that the engine 64 is not stopped, the CPU 61 returns to step S105. On the other hand, in the case that the engine 64 has stopped, the CPU 61 returns to step S101. It should be noted that after waiting for the lapse of a certain period of time, the CPU 61 may determine in step S109 whether or not the engine 64 has stopped.

According to the present preferred embodiment, the CPU 61 controls the engine 64 based on the vessel speed V, the judgment result of the lanyard connected state or the lanyard unconnected state, and the judgment result of "communication ON" or "communication OFF". As a result, it is possible to improve the user comfort with respect to the use of the lanyard 50.

Furthermore, in the case that the marine vessel navigates "at low speed" and the state of the wireless communication becomes "communication OFF", the CPU 61 determines that the vessel operator broke away from the hull 20 regardless of the detection result of the lanyard connected state or the lanyard unconnected state. As a result, during the marine vessel navigating "at low speed", it is possible to judge the presence or absence of "breakaway" based on the state of the wireless communication. Therefore, it is possible to maintain the emergency response function while maintaining the user comfort (the comfort of the vessel operator) during the marine vessel navigating "at low speed".

Furthermore, in the case that the marine vessel navigates "at high speed" and the lanyard 50 is in the lanyard unconnected state, it is judged that the situation is "breakaway" regardless of the judgment result of "communication ON" or "communication OFF". As a result, during the marine vessel navigating "at high speed", it is possible to quickly judge breakaway of the vessel operator from the hull 20.

Furthermore, in the case of judging that the situation is "breakaway", since the CPU 61 executes the dynamic positioning control ("fixed point holding") or stops the engine 64, it is possible to prevent the hull 20 from moving too far away from the vessel operator who broke away from the hull 20. In the case of judging that the situation is "breakaway" during the marine vessel navigating "at high speed", the CPU 61 may control the vessel speed V or the rotation speed NE with a physical quantity obtained at a time when it is judged that the situation is "breakaway" as the upper limit. In this case, the CPU 61 reads out the physical quantity stored last in step S107 from the RAM 63. This physical quantity read out from the RAM 63 is a physical quantity obtained at a time when it is judged last that the situation is "breakaway".

Furthermore, in the case that the marine vessel navigates "at low speed" and the lanyard 50 is in the lanyard unconnected state and the state of the wireless communication becomes "communication ON", the vessel speed V or the rotation speed NE is controlled with the predetermined value as the upper limit ("limited operation" is executed). As a result, it is possible to secure the low-speed navigation and reduce the movement of the hull 20 while maintaining the emergency response function, and the comfort is improved.

Furthermore, in the case that the marine vessel navigates "at high speed" and the lanyard 50 is in the lanyard connected state and the state of the wireless communication becomes "communication OFF", the engine 64 is controlled so that the vessel speed V or the rotation speed NE gradually decreases ("deceleration operation" is executed). As a result, in the case that there is a possibility that the vessel operator broke away from the hull 20, it is possible to reduce the speed at which the hull 20 moves away, and further, in the case that the battery of the wireless slave unit 54 is dead, it is possible to inform the vessel operator.

Further, before the engine is started, in the case that the state of the wireless communication is "communication OFF", the starting lock is set, and starting the engine is prohibited. As a result, the security lock function is enhanced as compared with a configuration in which the starting lock is released only by connecting the lanyard 50 to the lanyard switch 32. Further, the lanyard 50 provided with the wireless slave unit 54 is able to be used as an immobilizer.

Further, since the wireless slave unit 54 is integral with the lanyard 50, it is easy to use. However, the wireless slave unit 54 may be separate from the lanyard 50 and possessed or worn by the vessel operator. Alternatively, the mobile terminal device 100 may have the function of the wireless slave unit 54 by installing a predetermined application on the mobile terminal device 100 (FIG. 1).

As can be seen with reference to FIG. 5, the CPU 61 determines whether or not it is "breakaway" based on at least one of the judgment result of the lanyard connected state or the lanyard unconnected state, and the judgment result of "communication ON" or "communication OFF". In particular, the CPU 61 switches the determination whether or not it is "breakaway" based on the judgment result of the lanyard connected state or the lanyard unconnected state, or the judgment result of "communication ON" or "communication OFF" based on the vessel speed V. From these viewpoints as well, it is possible to improve the user comfort with respect to the use of the lanyard 50.

In addition, in a preferred embodiment of the present invention, in order for starting the engine 64 to be permitted, it is necessary that not only the lanyard 50 is connected to the lanyard switch 32 (step S101) but also the wireless slave unit 54 is wirelessly communicating with the communication unit 70 (step S102). However, in the case that the engine start switch 33 (see FIG. 2) is pressed down while the wireless slave unit 54 is not wirelessly communicating with the communication unit 70, the starting lock state may be released (a prohibition state may be released) by inputting the predetermined code such as a PIN code or a password. In this case, the engine 64 may be started on a condition that the engine start switch 33 is pressed down again within a predetermined time after the starting lock state is released.

Although the physical quantity used to determine "at high speed" and "at low speed" is any one of the vessel speed V, the rotation speed NE, and the physical quantity other than the vessel speed V and the rotation speed NE, it may be at least one of the vessel speed V, the rotation speed NE, and the physical quantity other than the vessel speed V and the rotation speed NE. That is, "at high speed" and "at low speed" may be determined by using a plurality of types of physical quantities. In order to deal with a case that the judgment results of "at high speed" and "at low speed" conflict with each other due to the plurality of types of physical quantities to be used, it may be determined in advance which physical quantity is to be prioritized. Alternatively, the judgment result obtained by using a physical quantity farthest from the corresponding judging threshold value among the plurality of types of physical quantities may be prioritized.

Although as the drive source that propels the hull 20, the engine 64 has been described, the drive source is not limited to the engine 64, and may be, for example, an electric motor. Therefore, preferred embodiments of the present invention are also able to be applied to electric water motorcycles and electric underwater motorcycles. The electric water motorcycle may be a saddle riding type electric water motorcycle or a standing riding type electric water motorcycle, and the electric underwater motorcycle may be a saddle riding type electric underwater motorcycle or a standing riding type electric underwater motorcycle. Further, preferred embodiments of the present invention are not limited a PWC, and are also able to be applied to various kinds of marine vessels that are propelled by outboard motors, inboard motors, or inboard/outboard motors.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A control device of a marine vessel, the control device comprising:

a wireless master unit to wirelessly communicate with a wireless slave unit that is able to be possessed or worn by a vessel operator; and a processor configured or programmed to function as:

a detecting unit to detect that an engaging portion of a lanyard connectable to a connecting portion provided on a hull of a marine vessel is detached from the connecting portion;

an obtaining unit to obtain a physical quantity that indicates at least one of a rotation speed of a drive source that propels the hull and a vessel speed;

a judging unit to judge a state of wireless communication between the wireless master unit and the wireless slave unit; and a control unit to control the drive source based on a detection result obtained by the detecting unit, the physical quantity obtained by the obtaining unit, and a judgment result obtained by the judging unit.

2. The control device according to claim 1, wherein, when the physical quantity does not exceed a threshold value and it is judged by the judging unit that the wireless communication between the wireless master unit and the wireless slave unit is not established, the control unit is configured or programmed to judge that the vessel operator broke away from the hull regardless of the detection result obtained by the detecting unit.

3. The control device according to claim 2, wherein the drive source is an engine, and the threshold value is a value equal to or lower than an idling speed of the engine.

4. The control device according to claim 2, wherein, when the physical quantity exceeds the threshold value and it is detected by the detecting unit that the engaging portion is detached from the connecting portion, the control unit is configured or programmed to judge that the vessel operator broke away from the hull regardless of the judgment result obtained by the judging unit.

5. The control device according to claim 2, wherein, when it is judged that the vessel operator broke away from the hull, the control unit is configured or programmed to stop the drive source, execute dynamic positioning control, or control the vessel speed or the rotation speed with a physical quantity obtained at a time when it is judged that the vessel operator broke away from the hull as an upper limit.

6. The control device according to claim 2, wherein, when the physical quantity does not exceed the threshold value and it is detected that the engaging portion is detached from the connecting portion and it is judged that the wireless communication is established, the control unit is configured or programmed to control the vessel speed or the rotation speed with a predetermined value as an upper limit.

7. The control device according to claim 2, wherein, when the physical quantity exceeds the threshold value, and it is not detected that the engaging portion is detached from the connecting portion and it is judged that the wireless communication is not established, the control unit is configured or programmed to control the drive source so that the vessel speed or the rotation speed gradually decreases.

8. The control device according to claim 1, wherein, before the drive source is started, when it is judged that the wireless communication between the wireless master unit and the wireless slave unit is not established, the control unit is configured or programmed to prohibit starting of the drive source.

9. The control device according to claim 8, wherein, when a starting instruction of the drive source is issued while prohibiting starting of the drive source because it is judged that the wireless communication between the wireless master unit and the wireless slave unit is not established, the control unit is configured or programmed to release a prohibition state of starting of the drive source on a condition that a predetermined code is inputted.

10. A control system of a marine vessel, the control system comprising:

a lanyard;

a wireless slave unit; and the control device according to claim 1; wherein the wireless slave unit is configured to wirelessly communicate with the wireless master unit of the control device.

11. The control system according to claim 10, wherein the wireless slave unit is integral with the lanyard.

12. A marine vessel comprising:

the control device according to claim 1.

13. A control system of a marine vessel, the control system comprising:

a lanyard including an engaging portion connectable to a connecting portion provided on a hull of a marine vessel and that is integral with a wireless slave unit;

a wireless master unit to wirelessly communicate with the wireless slave unit; and a processor configured or programmed to function as:

a detecting unit to detect that the engaging portion of the lanyard is detached from the connecting portion;

a judging unit to judge a state of wireless communication between the wireless master unit and the wireless slave unit; and a control unit to determine whether or not a vessel operator broke away from the hull based on at least one of a detection result obtained by the detecting unit and a judgment result obtained by the judging unit.

14. The control system according to claim 13, wherein the processor is configured or programmed to function as:

an obtaining unit to obtain a physical quantity that indicates at least one of a rotation speed of a drive source that propels the hull and a vessel speed; and the control unit is configured or programmed to switch judging whether or not the vessel operator broke away from the hull based on the detection result obtained by the detecting unit or the judgment result obtained by the judging unit based on the physical quantity obtained by the obtaining unit.

15. The control system according to claim 13, wherein, before a drive source that propels the hull is started, when it is judged that the wireless communication between the wireless master unit and the wireless slave unit is not established, the control unit is configured or programmed to prohibit starting of the drive source.

16. The control system according to claim 15, wherein, when a starting instruction of the drive source is issued while prohibiting starting of the drive source because it is judged that the wireless communication between the wireless master unit and the wireless slave unit is not established, the control unit is configured or programmed to release a prohibition state of starting of the drive source on a condition that a predetermined code is inputted.

* * * * *